United States Patent [19]

Wang et al.

[11] 4,002,397

[45] Jan. 11, 1977

[54] CONNECTOR FOR ELECTRIC PLUG

[75] Inventors: James P. Wang; David I. Wolsk, both of Lexington, Ky.

[73] Assignee: Wolsk Associates, Ltd., Lexington, Ky.

[22] Filed: Sept. 29, 1975

[21] Appl. No.: 617,706

[52] U.S. Cl. ..... 339/147 R; 339/154 R; 340/280

[51] Int. Cl.[2] ..... H01R 3/00

[58] Field of Search ..... 339/153, 147, 154 R, 339/154 A; 340/218, 280, 283; 58/53, 58, 23 R

[56] References Cited

UNITED STATES PATENTS

| | | | |
|---|---|---|---|
| 2,385,620 | 9/1945 | Fleckenstein | 339/123 X |
| 3,315,210 | 4/1967 | Cull | 339/192 R |
| 3,739,226 | 6/1973 | Seiter et al. | 315/156 X |
| 3,753,261 | 8/1973 | Thaxton | 340/253 R |
| 3,781,857 | 12/1973 | Stendig et al. | 340/280 X |

FOREIGN PATENTS OR APPLICATIONS

| | | | |
|---|---|---|---|
| 833,911 | 5/1960 | United Kingdom | 339/153 |

*Primary Examiner*—Joseph H. McGlynn
*Attorney, Agent, or Firm*—Frank C. Leach, Jr.

[57] ABSTRACT

A housing has two openings to receive the electrically conductive prongs of a plug to mount the housing and a third opening to receive the grounding prong. Electrically conductive strips are disposed within the housing and have the conductive prongs of the plugs, which pass through the two openings in the housing, pass through openings in the electrically conductive strips to be in contact with the strips to provide a source of power to the strips, which are electrically connected to an alarm circuit. The alarm circuit produces an audible signal whenever there is no current through the plug due to a power failure or the plug being removed from its power source and a battery, which is supported within the housing, is connected to this alarm circuit.

12 Claims, 7 Drawing Figures

3
7
42
66
43
41
25
78'
26
12
28
85
89
48
49
58
5
71
71'
93
35
47
59
70
70'
86
79
27
72
87
83
80
88
94
95
50
60
48
84
61
24
45
77
22
76
16
62
78
37
31
33
32
19
20
21
44
23
46
63
40
38
36
17
75
81
14
15
80'
10
34
91
90
92
18
11
21
20

CONNECTOR FOR ELECTRIC PLUG

In the copending patent application of William O. Richmond, Jr. for "Alarm Device," Ser. No. 510,376, filed Sept. 30, 1974, there is shown an alarm device for indicating when power is not supplied to an electrical device such as a home freezer, for example. In the aforesaid Richmond, Jr. application, the alarm device is connected by tapping leads to the wires extending from the plug, which is inserted in an electrical receptacle, to the freezer.

While this arrangement is satisfactory, it is desired to be able to connect the alarm device of the aforesaid Richmond, Jr. application without the necessity of any tap on. This avoids any possibility of the user making a faulty connection.

The present invention accomplishes this through providing a connector which may be easily mounted on the prongs of the plug without preventing the plug from having its prongs inserted sufficiently into the receptacle to receive electrical power therefrom. Thus, the present invention enables the alarm device of the aforesaid Richmond, Jr. application to be utilized without the necessity of any tap on wiring.

The connector of the present invention employs a housing within which the battery utilized with the alarm device of the aforesaid Richmond, Jr. application is supported. The battery is so supported within the housing that it cannot be removed without removing the housing from the plug when the plug is disposed in a receptacle. Thus, this prevents anyone from removing the battery clandestinely since the alarm device of the aforesaid Richmond, Jr. application produces the audible signal whenever there is no current and this occurs when the plug is removed from its receptacle as is required to remove the housing from the plug.

Accordingly, with the alarm device of the aforesaid Richmond, Jr. application being employed in an environment in which it might be desired to prevent someone from stealing an electrical component such as a television set, for example, the alarm device cannot be disabled through removing the battery without initially having to remove the housing of the present invention from the plug, and this can occur only through removing the plug from the receptacle. When this occurs, the alarm device produces the audible signal so that one cannot remove the battery to disable the alarm device without the audible signal being produced.

Additionally, the inability to reach the battery within the housing while the plug is connected to the receptacle also prevents any possibility of shock to a user. That is, there is no way in which the user can make contact with any of the circuit within the housing as long as the housing is mounted on the plug and the plug is in the receptacle.

An object of this invention is to provide a connector for mounting on an electrical plug.

Another object of this invention is to provide a housing for an alarm device responsive to the absence of electrical power.

Other objects of this invention will be readily perceived from the following description, claims, and drawings.

This invention relates to a connector for mounting on an electrical plug for disposition in an electrical receptacle without preventing prongs of the plug from being inserted sufficiently into the receptacle for connection to a source of power. The connector includes a housing, which is formed of an electrically insulating material, having a receptacle therein. A relatively thin portion, which extends from one side of the housing, has a recess and at least two openings therein communicating with the recess. A pair of electrically conductive strips is mounted in the recess in the thin portion with each of the strips having an opening therein with each of the openings aligned with the corresponding opening in the thin portion to enable one of the prongs of the plug to pass therethrough. The openings in the electrically conductive strips are smaller than the prongs of the plug to grasp the prongs of the plug when the prongs are inserted therein. Each of the electrically conductive strips is formed of a material capable of expanding to receive the prongs of the plug and substantially returning to its original shape after the prongs of the plug are withdrawn therefrom. Electrical means is disposed in the receptacle in the housing and connected to the electrically conductive strips to receive power therefrom when the plug is connected to a source of power through the electrical receptacle.

The attached drawings illustrate a preferred embodiment of the invention, in which.

Figure 1:
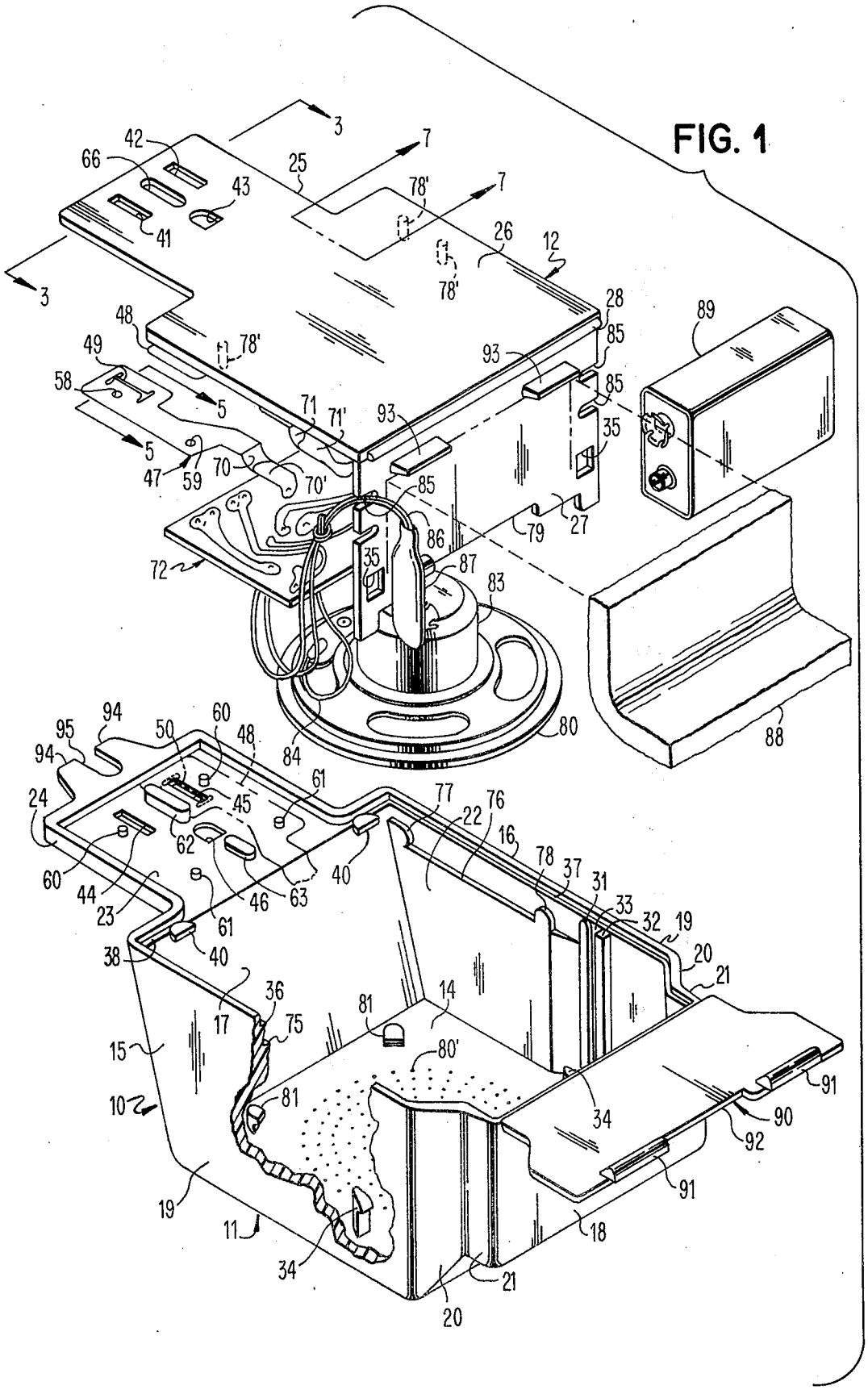
FIG. 1 is an exploded perspective view of the elements forming the connector of the present invention.

Referring to the drawings and particularly FIG. 1, there is shown a housing 10, which is formed of an electrically insulating material. One suitable example of the electrically insulating material is VO polypropylene, which is a fire retardant material. The housing 10 includes a portion 11 and a portion 12, which are connected to each other and preferably heat sealed to each other to form the housing 10.

The housing portion 11 includes a front wall 14, a pair of side walls 15 and 16, a top wall 17 sloping upwardly from the front wall 14, and a bottom wall 18. Each of the front wall 14 and the side walls 15 and 16 includes a first substantially vertical portion 19 having its upper end connected to the top wall 17, a second inclined portion 20 having its upper end connected to the lower end of the first portion 19, and a third portion 21 substantially parallel to the first portion 19 and having its ends connected to the bottom wall 18 and the lower end of the second portion 20.

The front wall 14, the side walls 15 and 16, the top wall 17, and the bottom wall 18 of the housing portion 11 form a receptacle 22 therein. The receptacle 22 communicates with a recess 23, which is formed in a reduced, thin portion 24 extending upwardly from the rear of the top wall 17.

The housing portion 12 is slightly thinner than the thickest part of the reduced, thin portion 24 of the portion 11. The upper end of the housing portion 12 has a reduced, thin portion 25, which cooperates with the reduced, thin portion 24 of the housing portion 11, extending upwardly from a main portion 26.

The housing portion 12 has a separating partition 27 extending from the lower end of the main portion 26 of the housing portion 12. The separating partition 27 is connected to the main portion 26 by a hinge 28 so that the separating partition 27 can be disposed substantially perpendicular to the main portion 26. The separatng partition 27 is slightly less in width than the main portion 26 and has its sides converging toward each other.

The separating partition 27 is supported within the receptacle 22 in the housing portion 11 to divide the receptacle 22 into an upper chamber and a lower chamber. The inner surface of each of the side walls 15 and 16 has a pair of substantially parallel ridges 31 and 32 extending therealong to form a support groove 33 therebetween to receive one of the converging sides of the separating partition 27 for support thereby.

The inner surface of the front wall 14 of the housing portion 11 has a pair of lugs 34 extending substantially horizontal therefrom into the receptacle 22 for disposition in a pair of openings 35 in the separating partition 27. The disposition of the lugs 34 in the openings 35 insures that the separating partition 27 is disposed at the desired position within the receptacle 22 and holds the separating partition 27 in the desired position.

When the portion 12 is connected to the portion 11, the portion 12 does not extend beyond the rear edges of the portion 11. Accordingly, a retaining ridge 36 is provided along the inner surface of the side wall 15 adjacent its rear edge and a retaining ridge 37 is provided along the inner surface of the side wall 16 adjacent its rear edge to limit the inward movement of the main portion 26 of the housing portion 12 about its hinged connection to the separating partition 27. The inner surface of the top wall 17 of the portion 11 also has a retaining ridge 38 adjacent its rear edge for the main portion 26 of the portion 12.

Figure 7:
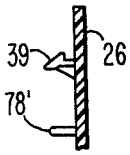
FIG. 7 is a fragmentary sectional view taken along line 7—7 of FIG. 1.

The inner surface of the main portion 26 of the portion 12 has a pair of lugs 39 (one shown in FIG. 7) at its upper end for locking engagement with a pair of lugs 40 on the inner surface of the top wall 17 adjacent its rear edge. Thus, the main portion 26 of the portion 12 is locked to the portion 11 by the lugs 39 engaging the lugs 40.

The reduced, thin portion 25 of the housing portion 12 fits within the recess 23 in the portion 11. The reduced, thin portion 25 has openings 41—43 formed therein and alinged with openings 44—46, respectively, in the reduced, thin portion 24 of the housing portion 11 when the portion 12 is secured to the portion 11.

A pair of electrically conductive strips 47 and 48 is disposed within the recess 23 in the portion 11 and extends into the upper chamber of the receptacle 22 in the portion 11. The electrically conductive strip 47 has an opening 49 aligned with the opening 41 in the reduced, thin portion 25 and the opening 44 in the thin portion 24. The electrically conductive strip 48 has an opening 50 aligned with the opening 42 in the reduced, thin portion 25 and with the opening 45 in the reduced, thin portion 24.

Figure 5:
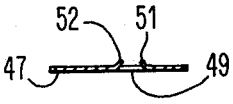
FIG. 5 is a fragmentary sectional view showing one of the openings in an electrical conductor strip and taken along line 5—5 of FIG. 1.

Each of the openings 49 and 50 preferably has an I-shape. Each of the openings 49 and 50 has a pair of lips 51 and 52 (see FIG. 5) along the vertical portion of its I-shape with the lips 51 and 52 extending towards the portion 12. Each of the openings 49 and 50 is adapted to have one of the prongs 53 (see FIG. 6) of an electrical plug 54 pass therethrough prior to being disposed within an electrical receptacle 55 of a receptacle plate 55A mounted in a wall 55B, for example.

While each of the openings 41, 42, 44, and 45 is larger than the prong 53 passing therethrough, the lips 51 and 52 of each of the I-shaped openings 49 and 50 have a smaller distance therebetween than the thickness of the prong 53 of the plug 54 passing therethrough. This insures that there is a grasping engagement by the lips 51 and 52 with the prong 53 of the plug 54 when it is passed therethrough to insure electrical contact therebetween. Thus, the lips 51 and 52 of each of the openings 49 and 50 must give when the prong 53 of the plug 54 passes therethrough because of the prong 53 being thicker than the distance between the lips 51 and 52. At the same time, the lips 51 and 52 must return to their original or initial position when the prong 53 of the plug 54 is withdrawn to insure that the insertion of the prong 53 of the plug 54 into the openings 49 and 50 results in the lips 51 and 52 again grasping the prong 53.

Accordingly, the material of the electrically conductive strips 47 and 48 must be capable of not only having resiliency so that the lips 51 and 52 of each of the openings 49 and 50 give when the prongs 53 of the plug 54 pass through the openings 49 and 50 but that the lips 51 and 52 of each of the openings 49 and 50 return substantially to their initial position when the prong 53 of the plug 54 is withdrawn. One suitable example of the electrically conductive strips 47 and 48 is beryllium copper. Any other suitable electrically conductive material, which has the desired characteristics, may be employed.

Depending on the stiffness of the material of the electrically conductive strips 47 and 48, the lips 51 and 52 of each of the openings 49 and 50 may not be formed prior to assembly. Instead, the lips 51 and 52 would be formed during the first insertion of the prongs 53 into the openings 49 and 50.

When the material of the electrically conductive strips 47 and 48 is beryllium copper, one-fourth hard beryllium copper has a relatively low stiffness so that the lips 51 and 52 do not have to be formed until the prongs 53 pass through the openings 49 and 50 the first time. With the electrically conductive strips 47 and 48 formed of one-half hard beryllium copper, the lips 51 and 52 must be formed in the conductive strips 47 and 48 prior to assembly since this material has a relatively large stiffness so as to grasp the prongs 53 upon insertion into the openings 49 and 50 and not readily release them if the lips 51 and 52 are not formed at a desired angle.

Figure 3:
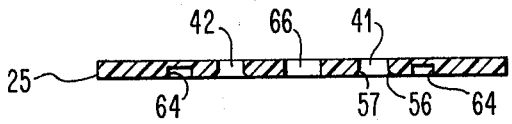
FIG. 3 is a sectional view taken along line 3—3 of FIG. 1.
Figure 4:
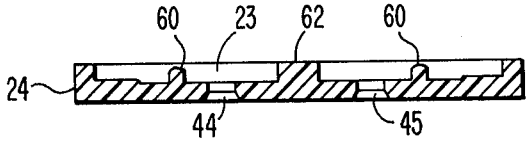
FIG. 4 is a sectional view taken along line 4—4 of FIG. 2.
Figure 2:
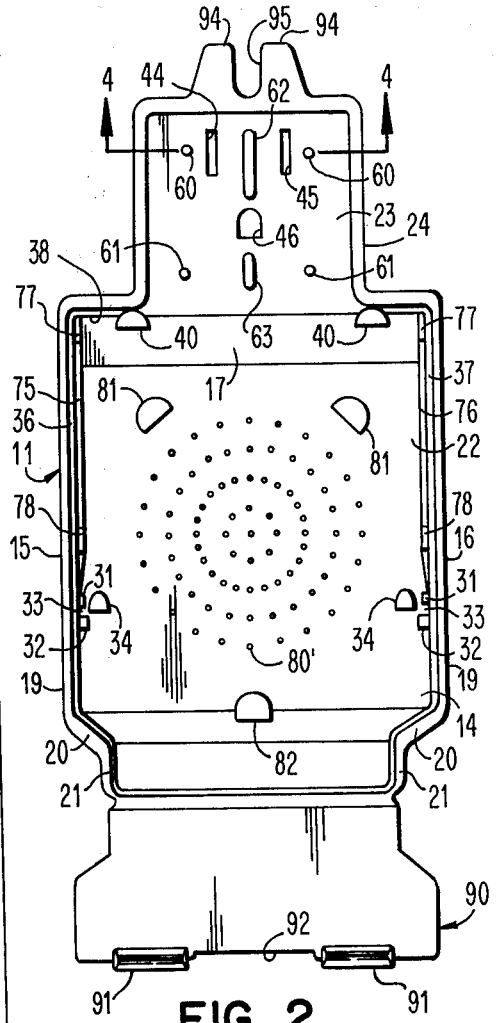
FIG. 2 is a rear elevational view of a portion of a housing of the connector of FIG. 1.

To insure that the lips 51 and 52 of each of the openings 49 and 50 are not creased by the insertion of the prong 53 of the plug 54 to prevent return of the lips 51 and 52 of each of the openings 49 and 50 to their initial position when the prong 53 is withdrawn, each of the openings 41 and 42 in the reduced, thin portion 25 has its sides 56 and 57 (see FIG. 3) curved along a radius at the inner surface thereof. This insures that the lips 51 and 52 of each of the openings 49 and 50 can give when the prong 53 of the plug 54 is inserted therein without being overly creased by contact with the housing portion 12.

Each of the electrically conductive strips 47 and 48 has a pair of openings 58 and 59 to receive guide or locating pins 60 and 61, respectively, extending from the reduced, thin portion 24 to locate the strips 47 and 48 in the recess 23. The reduced, thin portion 24 has a projection 62 disposed between the openings 44 and 45 to prevent the electrically conductive strips 47 and 48 from contacting each other. Similarly, there is a second projection 63, which is beneath the opening 46, and between the guide or locating pins 61 to also insure that there is no contact of the electrically conductive strips 47 and 48.

The third opening 43 in the reduced, thin portion 25 and the corresponding third opening 46 in the thin portion 24 cooperate to form an opening through the housing 10 for a grounding prong whenever the plug 54 is of the three-prong type. The electrically conductive strips 47 and 48 are shaped so that they are spaced from the openings 43 and 46 as shown in phantom in FIG. 1 for the conductive strip 48.

To enable the inner surface of the reduced, thin portion 25 of the housing portion 12 to fit against the inner surface of the reduced, thin portion 24 of the housing portion 11, the inner surface of the portion 12 has recesses 64 (see FIG. 3) for each of the guide or locating pins 60 and for each of the guide or locating pins 61. The inner surface of the reduced, thin portion 25 also has an opening 66 for the projection 62 on the reduced, thin portion 24 and a recess (not shown) for the projection 63 on the reduced, thin portion 24.

The projection 62 is heat sealed within the opening 66 to connect the housing portions 11 and 12 to each other. The housing portions 11 and 12 are also connected to each other by the lugs 34 on the housing portion 11 engaging the openings 35 in the separating partition 27 of the housing portion 12 and the pair of the lugs 39 on the inner surface of the main portion 26 of the housing portion 12 having locking engagement with the pair of the lugs 40 on the inner surface of the top wall 17 of the housing portion 11.

Accordingly, when the housing portions 11 and 12 are secured to each other with the reduced, thin portion 25 disposed within the recess 23 in the reduced, thin portion 24, the electrically conductive strips 47 and 48 are sandwiched or compressed therebetween. However, the electrically conductive strips 47 and 48 have their lower ends 70 and 71, respectively, extend into the upper chamber of the receptacle 22 in the housing portion 11. The lower ends 70 and 71 of the electrically conductive strips 47 and 48 are soldered to metallic portions 70′ and 71′, respectively, of a printed circuit board 72, which has the alarm circuit of the aforesaid Richmond, Jr. application formed thereon.

The printed circuit board 72 is supported on support ridges 75 and 76 on the inner surfaces of the side walls 15 and 16, respectively. As shown in FIG. 1, the ridges 75 and 76 are disposed closer to the front wall 14 than the ridges 36 and 37 of the side walls 15 and 16, respectively, so that the printed circuit board 72 is spaced forwardly from the housing portion 12. Each of the support ridges 75 and 76 has stops 77 and 78 at each end thereof to control the location of the printed circuit board 72 within the upper chamber of the receptacle 22.

The printed circuit board 72 is held against the support ridges 75 and 76 by pins 78′ on the inner surface of the main portion 26 of the housing portion 12. There are two of the pins 78′ on one side of the main portion 26 of the housing portion 12 and one of the pins 78′ on the other side. This arrangement insures that the pins 78′ will not engage any of the electrically conductive portions of the printed circuit board 72.

The separating partition 27 of the housing portion 12 has its forward edge 79 spaced rearwardly from the inner surface of the front wall 14 between the lugs 34 to receive a portion of a speaker 80, which has openings 80′ in the front wall 14 aligned therewith. The speaker 80 also is supported by a pair of lugs 81, which are on the inner surface of the front wall 14 above the separating partition 27, and a stop 82, which is on the inner surface of the front wall 14 below the separating partition 27.

The speaker 80 has its base 83 resting on the separating partition 27. The speaker 80 is connected by electrical wires 84 to the printed circuit board 72.

The separating partition 27 has openings 85 extending therethrough adjacent the sides thereof to provide communication between the upper chamber and the lower chamber of the receptacle 22. This enables wires 86 to extend from the printed circuit board 72 to a battery connector 87 within the lower chamber of the receptacle 22.

The lower chamber of the receptacle 22 has a foam protective element 88 mounted therein and secured to the bottom surface of the separating partition 27 of the portion 12 and to the inner surface of the front wall 14. The foam protective element 88 protects a portion of the speaker 80, which is disposed within the lower chamber of the receptacle 22, from a battery 89, which is connected to the battery connector 87. The foam protective element 88 also prevents the battery 89 from vibrating. The spacing between the third portions 21 of the side walls 15 and 16 is such as to receive a portion of the battery 89 therebetween at an angle to the bottom wall 18 while the battery connector 87 is disposed on the second portion 20 of one of the side walls 15 and 16 and adjacent the first portion 19 thereof.

The lower chamber of the receptacle 22 is closed by a hinged cover 90. The cover 90 is hinged to the rear edge of the bottom wall 18 of the housing portion 11. The cover 90 has locking lugs 91 extending from its upper edge for disposition beneath the hinge 28 of the portion 12. Accordingly, the battery 89 may be easily removed from the lower chamber of the receptacle 22 in the housing 10 through removing the locking lugs 91 from engagement with the hinge 28 by inserting any suitable instrument within a space, which is formed between a portion 92 of the cover 90 and the hinge 28.

The inward movement of the cover 90 is limited by a pair of stops 93 extending downwardly from the separating partition 27. One end of the foam protective element 88 engages the opposite side of each of the stops 93 from that side engaging the cover 90.

Figure 6:
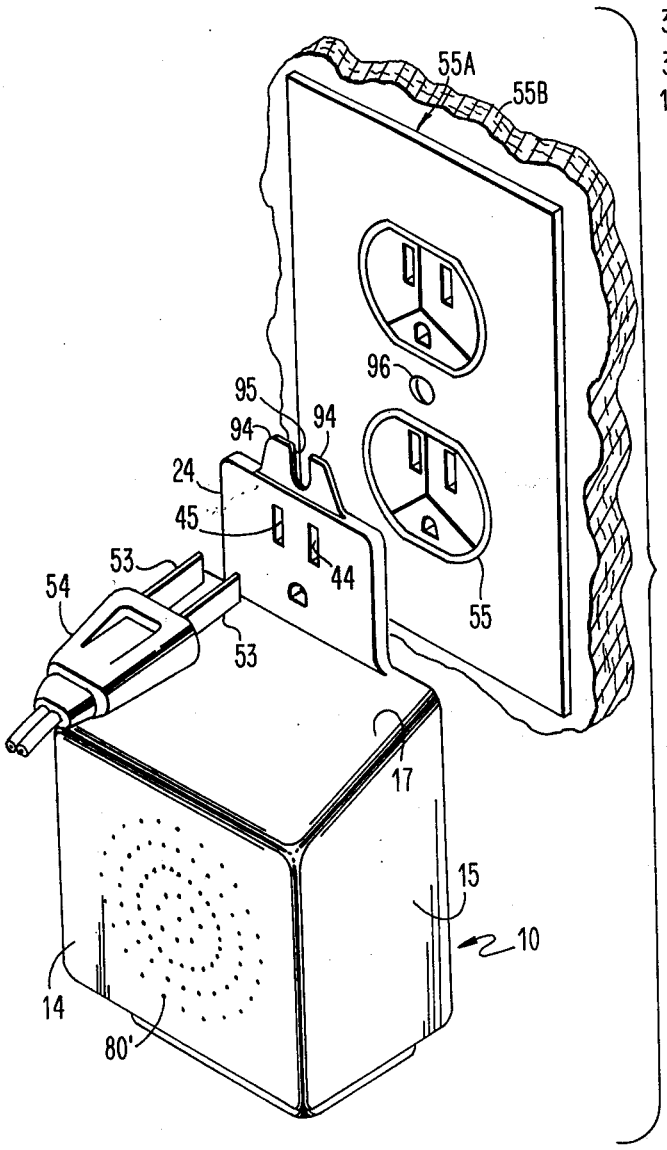
FIG. 6 is a schematic perspective view showing the relationship of the connector of the present invention with respect to a plug in a receptacle.

The upper edge of the thin portion 24 of the housing portion 11 has a pair of protrusions 94 extending therefrom to form a slot 95 therebetween. As shown in FIG. 6, the protrusions 94 are thinner than the reduced, thin portion 24 and have their rear surface in the same plane as the rear surface of the reduced, thin portion 24.

The slot 95 is utilized to receive a grounding prong of the plug 54 if the receptacle 55 should be formed with the outlet of the grounding plug above its two conductive outlets rather than below as shown in FIG. 6. Furthermore, in certain situations, it may be desired to affix the housing 10 to the receptacle plate 55A. Accordingly, a screw 96, which holds the receptacle plate 55A to the wall 55B, may be passed through the slot 95 to retain the housing 10 against the receptacle plate 55A.

While the present invention has shown and described the housing 10 as being utilized with an alarm device of the type shown and described in the aforesaid Richmond, Jr. application, it should be understood that the housing 10 may be employed to support any electrical means, which it is desired to connect to an electrical plug without the necessity of tap on wiring and without preventing the plug from making electrical contact with the contacts within an electrical receptacle. Thus, any suitable electrical means may be utilized within the housing 10 of the present invention.

An advantage of this invention is that it enables an alarm device to be utilized to sense the absence of electrical power without any separate plug. Another advantage of this invention is that it may be readily employed with any plug without requiring any tap on wiring while still providing the necessary alarm signal. A further advantage of this invention is that it has a relatively low cost.

For purposes of exemplification, a particular embodiment of the invention has been shown and described according to the best present understanding thereof. However, it will be apparent that changes and modifications in the arrangement and construction of the parts thereof may be resorted to without departing from the spirit and the scope of the invention.

We claim:

1. A connector for mounting on an electrical plug for disposition in an electrical receptacle without preventing prongs of the plug from being inserted sufficiently into the receptacle for connection to a source of power including:

a housing of an electrically insulating material;

said housing having a receptacle therein, said housing fully enclosing said receptacle;

said housing having a relatively thin portion extending from one side thereof and away from said receptacle;

said thin portion having at least two openings extending therethrough;

a pair of electrically conductive strips mounted within said thin portion, each of said electrically conductive strips having an opening therein with each of said openings aligned with the corresponding opening in said thin portion to enable one of the prongs of the plug to pass therethrough;

said openings in said electrically conductive strips being smaller than the prongs of the plug to grasp the prongs of the plug when the prongs are inserted therein;

each of said electrically conductive strips being formed of a material capable of expanding to receive the prongs of the plug and returning substantially to its original shape after the prongs of the plug are withdrawn therefrom;

and electrical means disposed in said receptacle in said housing and connected to said electrically conductive strips to receive power therefrom when the plug is connected to a source of power through the electrical receptacle.

2. The connector according to claim 1 including said thin portion having a width less than the width of said housing in a direction substantially normal to the thickness of said thin portion.

3. The connector according to claim 1 in which:

said housing comprises at least two portions connected to each other and having said receptacle enclosed thereby;

one of said portions has the space of said receptacle therein in which the electrical means is disposed;

said one portion has a relatively thin portion extending from one side thereof;

another of said portions of said housing has a thin portion for cooperation with said thin portion of said one portion to form said thin portion of said housing;

one of said thin portions of said one portion and said another portion has a recess therein, said electrically conductive strips being mounted in said recess;

and each of said thin portions of said one portion and said another portion has at least two openings therein and aligned with the corresponding opening in the other of said thin portions and the corresponding opening in said electrically conductive strip when said one portion and said another portion are connected to each other.

4. The connector according to claim 3 in which said thin portion of said one portion has said recess therein.

5. The connector according to claim 3 in which each of said openings in each of said thin portions of said one portion and said another portion is larger than said opening in each of said electrically conductive strips.

6. The connector according to claim 5 in which each of said thin portions of said one portion and said another portion has a third opening therein aligned with the corresponding third opening in the other of said thin portions of said one portion and said another portion when said one portion and said another portion are connected to each other, said third openings adapted to receive a grounding prong of the plug.

7. The connector according to claim 3 including:

means to divide said receptacle into two chambers;

one of said chambers having the electrical means therein;

and the other of said chambers having a battery for the electrical means therein.

8. The connector according to claim 7 including means supported by one of said portions of said housing to form a removable wall of said other chamber.

9. The connector according to claim 1 in which each of said openings in said thin portion is larger than said aligned opening in each of said electrically conductive strips.

10. The connector according to claim 9 in which:

said thin portion has a third opening therein adapted to receive a grounding prong of the plug;

and said electrically conductive strips are spaced from said third opening so that said electrically conductive strips do not contact the grounding prong on the plug passing through said third opening in said thin portion.

11. The connector according to claim 1 including:

means to divide said receptacle into two chambers;

one of said chambers having the electrical means therein;

and the other of said chambers having a battery for the electrical means therein.

12. The connector according to claim 1 including means supported by said housing to form a removable wall of said other chamber.

* * * * *